US008989617B2

(12) United States Patent
Shalem et al.

(10) Patent No.: US 8,989,617 B2
(45) Date of Patent: Mar. 24, 2015

(54) PRINTER INTERNAL CLIMATE CONTROL

(75) Inventors: Nadav Shalem, Givatayim (IL); Moshe Peles, Rehovot (IL); Michael Melnik, Rehovot (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/110,395

(22) PCT Filed: May 24, 2011

(86) PCT No.: PCT/EP2011/058477

§ 371 (c)(1), (2), (4) Date: Oct. 7, 2013

(87) PCT Pub. No.: WO2012/159667

PCT Pub. Date: Nov. 29, 2012

(65) Prior Publication Data

US 2014/0029970 A1 Jan. 30, 2014

(51) Int. Cl.
*G03G 21/20* (2006.01)

(52) U.S. Cl.
CPC ..... *G03G 21/206* (2013.01); *G03G 21/203* (2013.01)
USPC ..... 399/94; 399/92; 399/97

(58) Field of Classification Search
USPC ..... 399/92, 93, 94, 97, 98; 347/18, 223
See application file for complete search history.

(56) References Cited

U.S. PATENT DOCUMENTS

| | | | | |
|---|---|---|---|---|
| 4,343,096 | A | 8/1982 | Bergland | |
| 5,443,007 | A | 8/1995 | Buenz | |
| 5,481,339 | A * | 1/1996 | De Cock et al. | 399/93 |
| 6,877,247 | B1 | 4/2005 | DeMoore | |
| 6,941,089 | B2 | 9/2005 | Rivera et al. | |
| 7,031,633 | B2 * | 4/2006 | Regan et al. | 399/94 |
| 7,850,274 | B1 | 12/2010 | Chang et al. | |
| 8,351,815 | B2 * | 1/2013 | Eden et al. | 399/92 |
| 2003/0091363 | A1 | 5/2003 | Hoffman et al. | |
| 2006/0117771 | A1 * | 6/2006 | Fujimori et al. | 62/176.1 |

FOREIGN PATENT DOCUMENTS

| | | |
|---|---|---|
| EP | 1346831 A1 | 9/2003 |
| JP | 2003154727 | 5/2003 |

* cited by examiner

*Primary Examiner* — Sandra Brase

(57) ABSTRACT

In one example, a climate control system for a printer includes: an air flow path from an intake for receiving warmer, dirtier aft from a printing area of the printer to an exhaust for returning cooler, cleaner air to the printing area of the printer; a first heat exchanger in the flow path for exchanging heat between warmer air coming from the intake and cooler air going to the exhaust; and a second heat exchanger in the flow path for receiving warmer, dirtier air from the first heat exchanger and passing cooler, cleaner air to the first heat exchanger. The second heat exchanger is configured to cool the air to a predetermined dew point temperature corresponding to a desired level of a contaminant in the air.

12 Claims, 4 Drawing Sheets

PRINTER INTERNAL CLIMATE CONTROL

BACKGROUND

Temperature and humidity can affect the performance of commercial and industrial printers. It may be desirable in some printing environments to actively control the temperature and humidity in the printer to improve print quality and to prolong the life of some of the printer components.

DRAWINGS

The same part numbers are used to designate the same or similar parts throughout the figures.

DESCRIPTION

A new climate control system for digital printing presses and other printers has been developed to help maintain desirable temperature and humidity conditions inside the printer while reducing the level of airborne contaminants in the printer environment. In one example of the new climate control system, warmer air from the printing area is treated to remove environmental contaminants by cooling the air to condense out contaminants in the incoming air stream. The treated air is reheated to the desired temperature before returning to the printing area. The system utilizes an economizer that exchanges heat between the warmer, untreated incoming air and the cooler, treated outgoing air to simultaneously pre-cool the untreated air and reheat the treated air, thus reducing the energy needed to clean and reheat the air. A bypass allows some of the cool, treated air to be diverted around the economizer to help regulate the temperature of the outgoing air. In this example, the system also includes a humidifier to selectively introduce clean water into the treated air stream as needed to maintain the desired humidity of the air returning to the printing area.

"Cleaner" air and "dirtier" air are used in this document to describe relatively lesser or greater amounts of a contaminant in the air.

Figure 1:
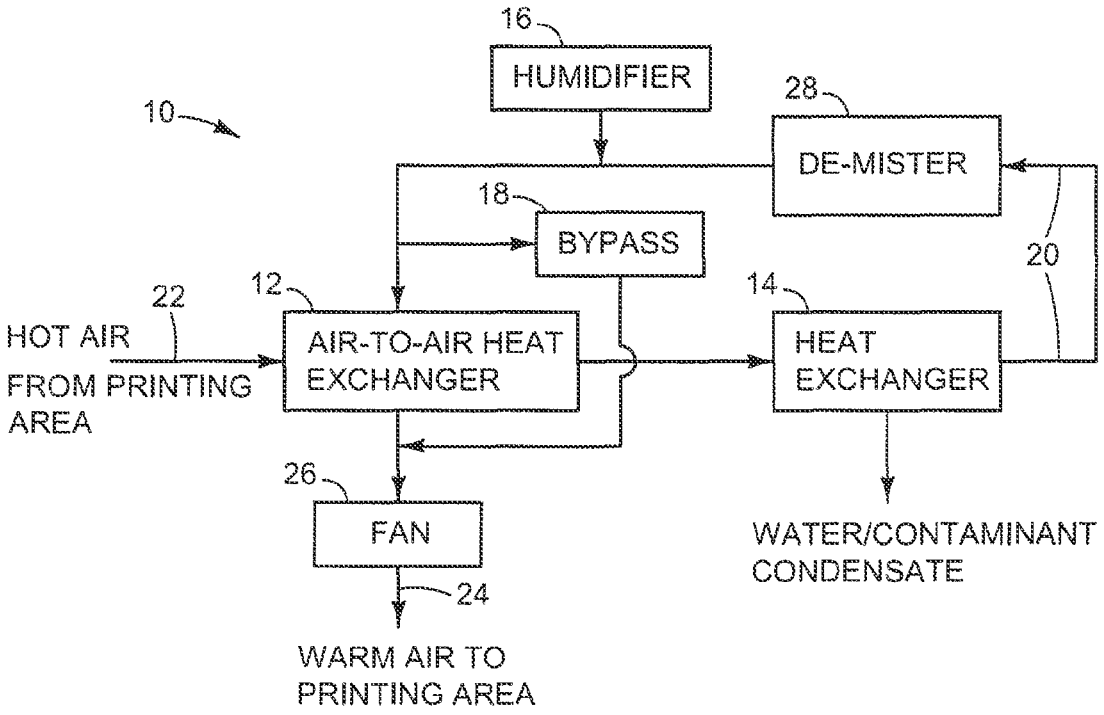
FIG. 1 is a block diagram illustrating one example of a new printer internal climate control system.

Referring now to the block diagram of FIG. 1, one example of a new printer climate control system 10 includes a first, economizer heat exchanger 12, a second heat exchanger 14, a humidifier 16 and a bypass 18. Economizer heat exchanger 12, which exchanges heat between the warmer incoming air and the cooler outgoing air without mixing the two air streams, is also sometimes referred to in this document as an air-to-air heat exchanger. As described in more detail below with reference to the example shown in FIG. 3, the components of system 10 are arranged along an air flow path 20 extending from an intake 22 for receiving warmer, dirtier air from a printing area of the printer to an exhaust 24 for returning cooler, cleaner air to the printing area. In the embodiment shown in FIG. 1, climate control system 10 also includes a fan 26 for moving air along flow path 20.

In operation, the warmer, dirtier incoming air passes through first heat exchanger 12 where it is cooled by cooler, cleaner outgoing air. The now cooler but still untreated incoming air then passes through second heat exchanger 14 where it is cooled to a predetermined dew point temperature corresponding to a desired level of contaminants remaining in the air that will be returned to the printing area. For example, the ink and toner used in some printing processes generate unwanted vapors, sometimes referred to as "VOCs" (volatile organic compounds), VOC contaminants may be removed by cooling the air in second heat exchanger 14 sufficiently to condense contaminant vapors. The dew point temperature selected to reduce contaminant levels will also establish the maximum level of humidity for the air leaving second heat exchanger 14. The liquid condensate is removed from second heat exchanger 14 for disposal or recycling.

With continued reference to FIG. 1, having been treated to remove contaminants, the cool, cleaner air from second heat exchanger 14 moves past or through humidifier 16. Humidifier 16 adds water selectively, as needed, to increase the humidity in the outgoing air stream to the desired level. Outgoing air passes through air-to-air first heat exchanger 12 where it is heated by the warmer incoming air. Some of the cool, treated air is diverted selectively past first heat exchanger 12 though bypass 18, as needed, to adjust the temperature of the return air to the desired level.

Climate control system 10 may also include a filter or other suitable de-mister 28 for removing liquid droplets from the air downstream from second heat exchanger 14. In some operating conditions for a climate control system 10, the air stream downstream from second heat exchanger 14 may contain a fog or mist of residual contaminants. Under these operating conditions, it may be desirable to include a demister 28 to help prevent any such residual contaminant droplets from returning to the printing area.

Figure 2:
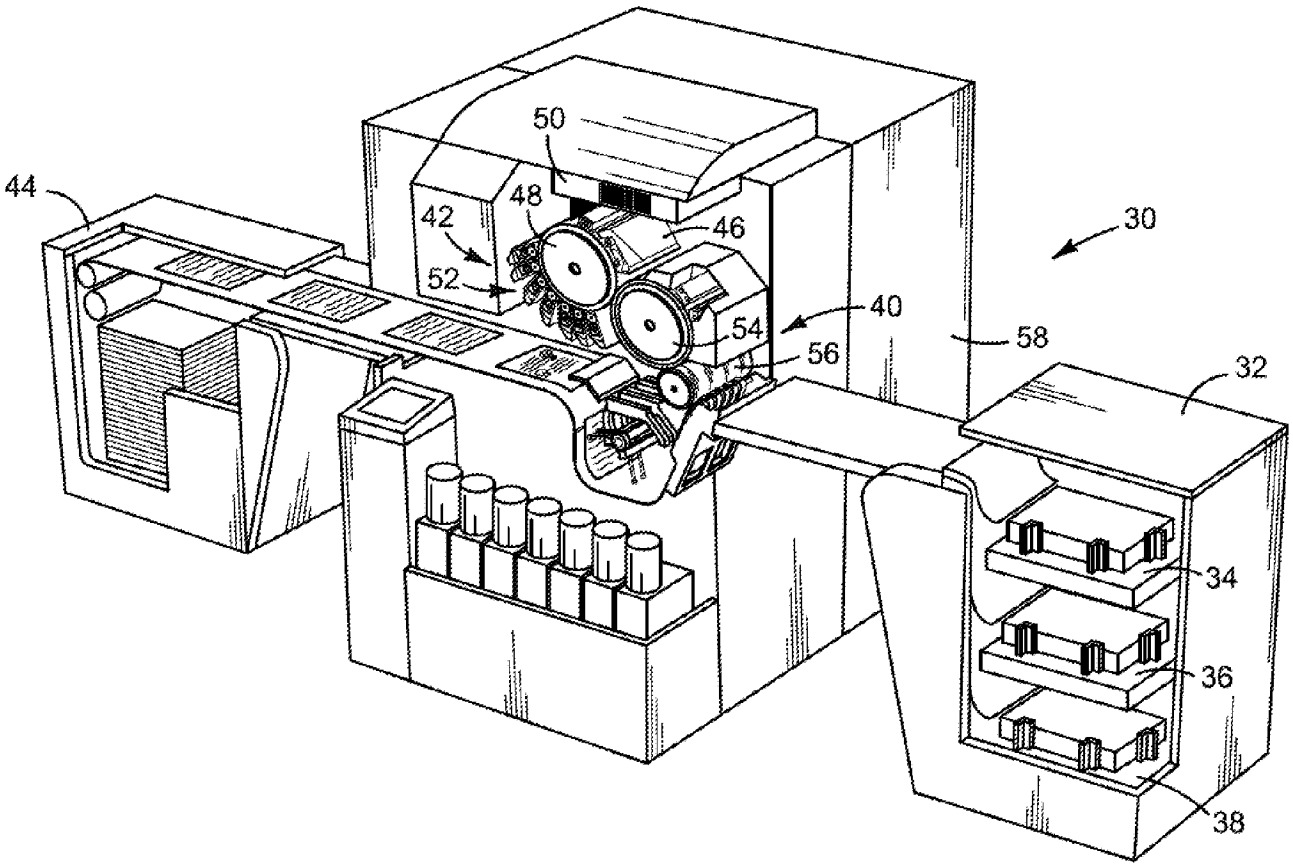
FIG. 2 illustrates one type of printer in which examples of the new climate control system may be implemented.
Figure 3:
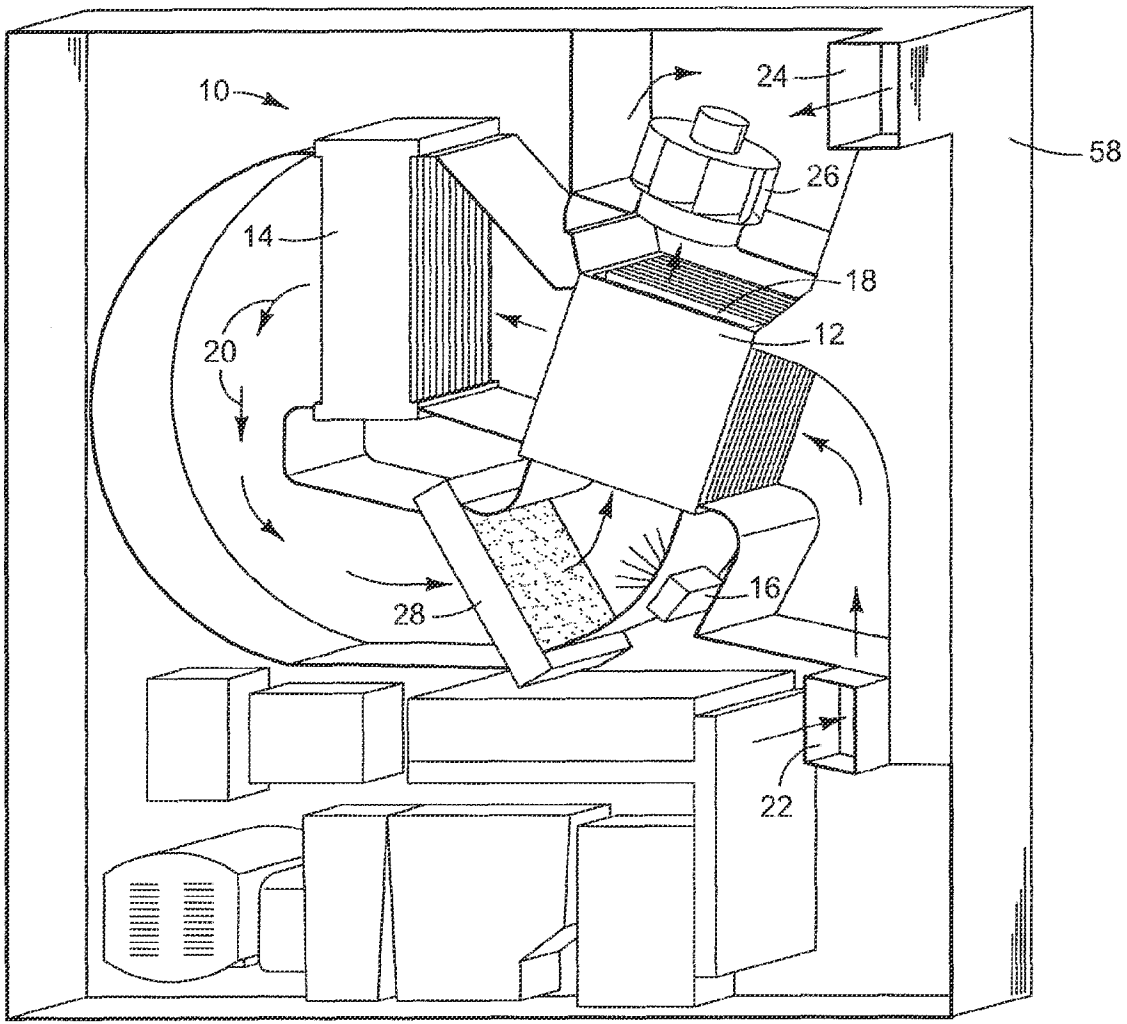
FIG. 3 illustrates one example of a climate control system such as might be used in the printer of FIGS. 2.

FIG. 2 illustrates one type of a printer 30 in which examples of the new climate control system may be implemented. FIG. 3 illustrates one example of a climate control system 10 for use in printer 10. Printer 30 shown in FIG. 2 uses a liquid electro-photographic (LEP) printing process to form images on paper or other print media. LEP printer 30 is one example of a printer that can benefit from the use of a climate control system 10 (FIG. 3) to lower VOC levels and to help maintain the desired temperature and humidity in the printer's internal operating environment.

Referring to FIG. 2, printer 30 includes a media feed unit 32 with multiple media input trays 34, 36, and 38. Sheets of a print medium are fed from stacks 34, 36, and 38 to a printing area 40 in the print engine 42 from which they emerge as printed sheets conveyed to an output stacker 44. Although printing area 40 and print engine 42 are enclosed during printing operations, the forward part of the printer enclosure is omitted in FIG. 2 to show printing area 40 and print engine 42.

Print engine 42 includes a charging device 46 for charging the surface of a photoconductive drum 48. A photo imaging device 50 exposes selected areas of drum 48 to light in the pattern of the desired printed image. A thin layer of liquid toner is applied to the patterned drum 48 through a series of developer units 52 to develop the latent image on drum 48 into a toner image. The toner image is transferred from drum 48 to the outside surface of an intermediate transfer member 54. The toner image is then transferred to the print medium as the print medium passes through a nip between intermediate transfer member 54 and a pressure roller 56, VOCs generated as toner carrier fluid evaporates off intermediate transfer member 54 are evacuated to a cooling cabinet 58 housing climate control system 10 at the back of printer 30.

Referring now to FIG. 3, hot, "dirty" air from printing area 40 (FIG. 2) is evacuated to climate control system 10 in cabinet 58 through intake 22, for example at the urging of a suction blower 26. Air with a comparatively high concentration of VOCs from printing area 40 may reach intake 22 at about 42° C., for example. The warmer, untreated incoming air passes through air-to-air heat exchanger 12 to heat the cooler, treated outgoing air as described above with reference to FIG. 1. Thus, the warmer incoming air is cooled as it passes through first heat exchanger 12, for example to about 33° C.

The now cooler but still untreated air then passes through second heat exchanger 14 where it is cooled to a predetermined dew point temperature corresponding to a desired level of VOCs remaining in the air that will be returned to print engine 42 (FIG. 2). In one example for an LEP printing press 30, the level of VOCs may be reduced to about 200 ppm by cooling the incoming air to about 10° C. at second heat exchanger 14. The liquid condensate containing water and toner carrier fluid that collects in second heat exchanger 14 is removed for recycling or disposal.

In the example shown in FIG. 3, an optional de-misting filter 28 is included in the flow path downstream from second heat exchanger 14 to remove droplets that may form as fog in the cool air exiting second heat exchanger 14. For LEP printing applications, if a de-mister 28 is used, it is expected that de-mister 28 will be located as far as possible from second heat exchanger 14. Any droplets of carrier fluid remaining in the air flow downstream from second heat exchanger 14 tend to stick to one another and become larger, and thus easier to filter, farther from heat exchanger 14.

The cool air from second heat exchanger 14 moves past a humidifier 16 to first heat exchanger 12. Humidifier 16 and heat exchanger 12 control the humidity and temperature of the air returning to print engine 42 through exhaust 24. Humidifier 16 adds water selectively, as needed, to increase the humidity in the outgoing air stream to the desired level. Outgoing air then passes through air-to-air first heat exchanger 12 where it is heated by the warmer incoming air. Some of the cool, treated air is diverted selectively past first heat exchanger 12 though bypass 18, as needed, to adjust the temperature of the return air to the desired level, In one example for an LEP printer, the outgoing air at exhaust 24 should have a relative humidity of about 38% at a temperature of about 23° C. This temperature and humidity condition at climate control system exhaust 24 allows the air to reach printing area 40 (FIG. 2) at the desired operating conditions, for example about 30% relative humidity at about 27° C.

Figure 4:
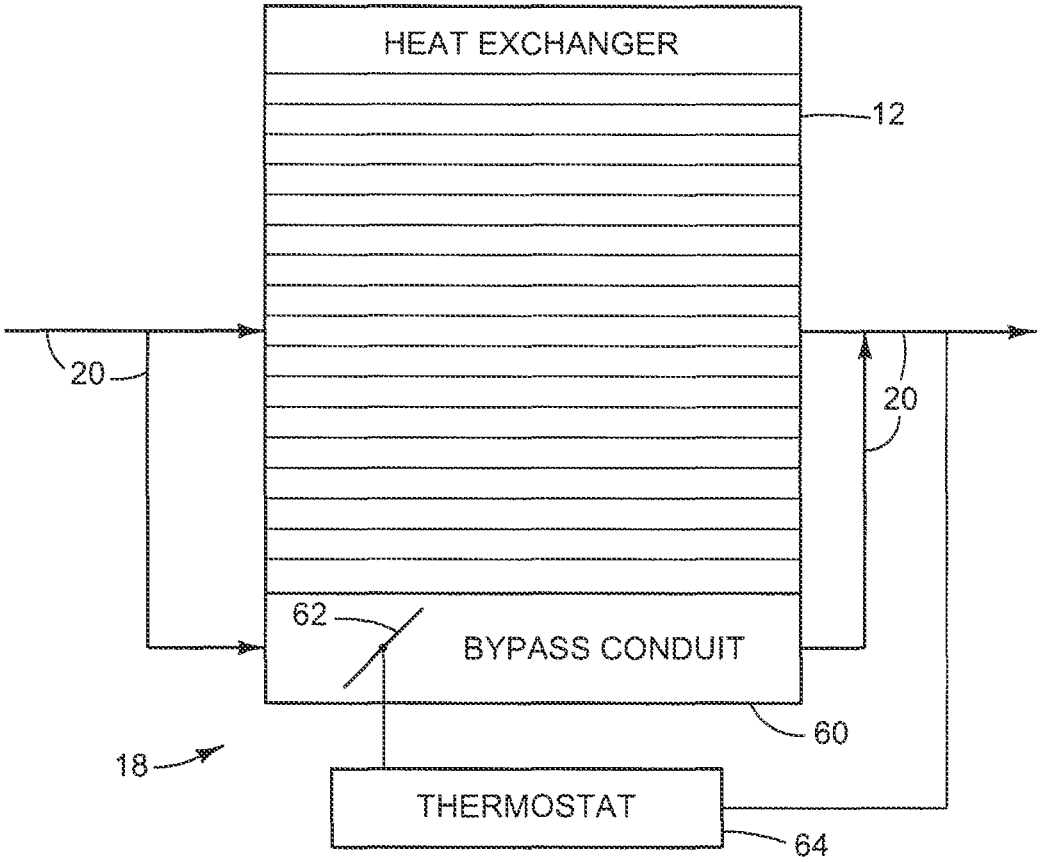
FIG. 4 is a block diagram illustrating one example for the bypass in the climate control systems shown in FIGS. 1 and 3.

FIG. 4 is a block diagram illustrating one example for bypass 18 in system 10. Referring to FIG. 4, bypass 18 includes an air flow conduit 60 bypassing heat exchanger 12, a flow control valve 62, and a thermostat or other suitable control mechanism 64 operatively connected between the outgoing air flow and flow control valve 62. Thermostat 64 automatically adjusts the position of valve 62 based on the temperature of the outgoing air to control the flow of cool air through bypass conduit 60, and maintain the desired temperature of air returning to the print engine.

Figure 5:
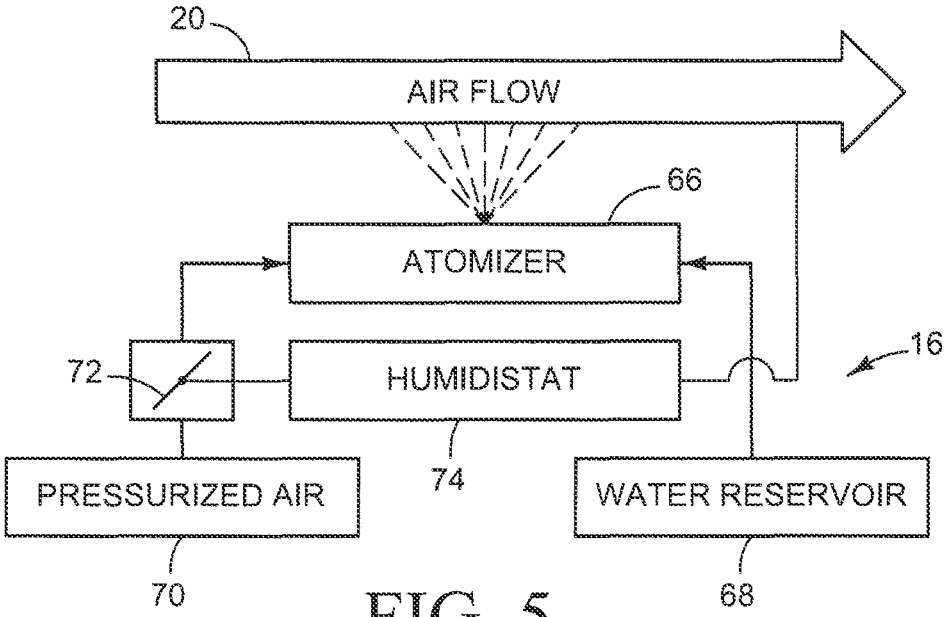
FIG. 5 is a block diagram illustrating one example for the humidifier in the climate control systems shown in FIGS. 1 and 3.

FIG. 5 is a block diagram illustrating one example for humidifier 16 in system 10. Referring to FIG. 5, humidifier 16 includes an atomizer 66 connected to a water reservoir 68 and a source of pressurized air 70. Humidifier 16 also includes an air flow control valve 72 and a humidistat or other suitable control mechanism 74 operatively connected between the outgoing air flow and flow control valve 72. Humidistat 74 automatically adjusts the position of valve 72 based on the humidity of the outgoing air to control the amount of water sprayed into the flow of air through second heat exchanger 14, and maintain the desired humidity of air returning to the print engine.

Locating humidifier 16 upstream from heat exchanger 12 as shown in FIG. 3 may be desirable in some printing environments to help ensure the water droplets will vaporize fully into the outgoing air stream, and thus minimize the risk of any water droplets reaching the print engine. However, in other printing environments it may be suitable to locate humidifier 16 downstream from heat exchanger 12.

The examples shown in the figures and described above illustrate but do not limit the invention. Other examples, embodiments and implementations are possible. Therefore, the foregoing description should not be construed to limit the scope of the invention, which is defined in the following claims.

What is claimed is:

1. A climate control system for a printer, comprising:

an air flow path from an intake for receiving air from a printing area of the printer to an exhaust for returning air to the printing area of the printer;

an air-to-air first heat exchanger in the flow path, the first heat exchanger configured to exchange heat between air coming from the intake and air going to the exhaust; and a second heat exchanger in the flow path, the second heat exchanger configured to cool air from the first heat exchanger to a dew point temperature corresponding to a level of a contaminant in the air and pass cooled air to the first heat exchanger.

2. The system of claim 1, further comprising a bypass in the flow path downstream from the second heat exchanger through which some of the cooled air may be diverted past the first heat exchanger toward the exhaust.

3. The system of claim 1, further comprising a humidifier in the flow path downstream from the second heat exchanger for selectively adding water to the return air.

4. The system of claim 3, wherein the humidifier is located in the flow path between the second heat exchanger and the first heat exchanger.

5. The system of claim 1, further comprising a de-mister in the flow path downstream from the second heat exchanger between the second heat exchanger and the first heat exchanger for removing droplets from the air.

6. A climate control system for a printer, comprising:

an air flow path from an intake for receiving air from a printing area of the printer to an exhaust for returning air to the printing area of the printer;

an air-to-air first heat exchanger in the flow path, the first heat exchanger configured to exchange hear between air coming from the intake and air going to the exhaust;

a second heat exchanger in the flow path, the second heat exchanger configured to cool air from the first heat exchanger to a dew point temperature corresponding to a level of a contaminant in the air and pass cooled air to the first heat exchanger;

a humidifier in the flow path downstream from the second heat exchanger for selectively adding water to the return air; and a bypass in the flow path downstream from the second heat exchanger through which some of the cooled air may be diverted past the first heat exchanger toward the exhaust.

7. The system of claim 6, further comprising a de-mister in the flow path downstream from the second heat exchanger between the second heat exchanger and the first heat exchanger for removing droplets from the air.

8. The system of claim 6, wherein the bypass comprises:

an air flow conduit bypassing the first heat exchanger;

a flow control value operatively connected to the bypass conduit and configured to control the flow of air through the bypass conduit; and a thermostat operatively connected between the flow control valve and the air going to the exhaust, the thermostat configured to adjust the position of the flow control valve based on a temperature of the outgoing air.

9. The system of claim 6, wherein the humidifier comprises:

an atomizer configured to introduce water droplets into the return air; and a humidistat operatively connected between the atomizer and the air going to the exhaust, the humidistat configured to adjust the amount of water introduced into the return air by the atomizer based on a humidity of the outgoing air.

10. A climate control method for a printer, comprising:

receiving air from a printing area of the printer;

cooling air received from the printing area to a predetermined dew point temperature corresponding to a desired level of a contaminant in the air to form cleaner air;

simultaneously cooling air received from the printing area and heating the cleaner air to form heated, cleaner air; and then exhausting heated, cleaner air to the printing area of he printer.

11. The method of claim 10, further comprising humidifying the cleaner air before exhausting the cleaner air to the printing area of the printer.

12. The method of claim 10, wherein simultaneously cooling air received from the printing area and heating the cleaner air comprises simultaneously cooling the air received from the printing area with the cleaner air and heating the cleaner air with the air received from the printing area.

* * * * *

UNITED STATES PATENT AND TRADEMARK OFFICE

CERTIFICATE OF CORRECTION

PATENT NO. : 8,989,617 B2
APPLICATION NO. : 14/110395
DATED : March 24, 2015
INVENTOR(S) : Nadav Shalem et al.

It is certified that error appears in the above-identified patent and that said Letters Patent is hereby corrected as shown below:

In the claims

In column 4, line 51, in Claim 6, delete “hear” and insert -- heat --, therefor.

In column 6, line 9, in Claim 10, delete “he” and insert -- the --, therefor.

Signed and Sealed this
Fourteenth Day of June, 2016

Michelle K. Lee

Michelle K. Lee
*Director of the United States Patent and Trademark Office*